US006288016B1

(12) United States Patent
Ramanan et al.

(10) Patent No.: US 6,288,016 B1
(45) Date of Patent: Sep. 11, 2001

(54) DISINTEGRANT-IMPREGNATED DETERGENT AGGLOMERATES WITH IMPROVED SOLUBILITY

(75) Inventors: Ganapathy Venkata Ramanan; Noe Ongcoy Hidalgo; Rinko Katsuda; Tomotaka Inoue, all of Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/600,202

(22) Filed: Jul. 12, 2000

(51) Int. Cl.[7] ..... C11D 17/00

(52) U.S. Cl. ..... 510/357; 510/441; 510/443; 510/446

(58) Field of Search ..... 510/357, 440, 510/441, 443, 446

(56) References Cited

U.S. PATENT DOCUMENTS

| | | | |
|---|---|---|---|
| 4,370,250 | 1/1983 | Joshi | 252/135 |
| 4,642,197 | 2/1987 | Kruse et al. | 252/98 |
| 5,382,377 | 1/1995 | Raehse et al. | 252/174 |

FOREIGN PATENT DOCUMENTS

| | | | |
|---|---|---|---|
| 0 466 484 A2 | 1/1992 | (EP) | C11D/17/00 |
| 0 522 766 A2 | 1/1993 | (EP) | C11D/3/37 |

*Primary Examiner*—Necholus Ogden
(74) *Attorney, Agent, or Firm*—Marianne Dressman; Kim William Zerby; Steven W. Miller

(57) ABSTRACT

Granular detergent compositions are prepared by an agglomeration process and impregnated with a water-insoluble disintegrant to improve water solubility. Laundry detergent compositions are described.

1 Claim, No Drawings

DISINTEGRANT-IMPREGNATED DETERGENT AGGLOMERATES WITH IMPROVED SOLUBILITY

FIELD

The present invention relates to a detergent granule having improved dissolution. The present invention further relates to a surfactant-containing detergent granule having improved dissolution.

BACKGROUND

There is a current trend for commercially available granular detergent compositions to have higher bulk densities as well as higher active ingredient content. Such detergent compositions offer greater convenience to the consumer and at the same time, reduce the amount of packaging materials which will ultimately be disposed of. But for such granular detergent compositions, there are problems of poor dissolution resulting in residue and/or partially dissolved detergent clump/gel-like mass left on fabric, in the washing machine, or in a washing machine dispenser drawer. This residue can vary from fine particles to masses as large as 10 to 100 millimeters in size, and is very undesirable for consumers.

Although not wanting to be limited by theory, several examples are illustrated showing how poor dissolution may occur. For example, when consumers first put detergent composition and clothes in the washing machine prior to the addition of water in the tub, significant residue is left in the tub or on the clothes. This residue is formed as the machine is filling with water, since the detergent is trapped in the clothes and there is no agitation of the tub contents. Under these conditions, hydration and dissolution occur on the surface of the detergent, wherein the detergent forms a hydrated paste, or gel-like mass.

In another example, detergent compositions containing zeolite-built powders dispense poorly, especially when such compositions are placed in a dispenser drawer of a washing machine and/or a detergent dosing device. This poor dispensing may be caused by the formation of a gel-like mass, which have high levels of surfactant, upon contact with water. The gel-like mass prevents a proportion of the detergent powder from being solubilized in the wash water, which reduces the effectiveness of the detergent. These solubility problems especially occur in conditions having low water pressures and/or lower washing temperatures.

It is known that bleach activators in powder form do not remain stable when incorporated in detergent compositions. Therefore, such particles are used as extrudates or otherwise formed into larger bleach activator particles or bodies in order to maintain the stability of the bleach activator particles. But these large particles have dissolution problems in the wash solution. As a result, water-soluble disintegrants have been used in large bleach activator particles in order to have better dissolution of the bleach activators. In this technique, the water-soluble disintegrants are incorporated into the large bleach activator particle. Then, as moisture is exposed to the large particle, the water-soluble disintegrants solubilize in the wash solution, leaving gaps in the large particle, and thereby promote the rupturing of the large particle and release the activator particles to the water.

It is also known to use disintegrating aids in bleach activator particles that are not very water-soluble, but are water-swellable in the presence of water, such as upon contact with the wash solution. In this technique, larger particles containing these water-swellable disintegrants break up into small particles due to the swelling up of the disintegrants, thus releasing the activator into the wash solution.

It has now been surprisingly found that the use of substantially water-insoluble disintegrants can improve the dissolution of detergent granules containing high levels of surfactant. Particularly, it has been surprisingly found that the water-insoluble disintegrants improve the dissolution of residue and/or partially dissolved detergent clump/gel-like masses.

None of the existing art provides all of the advantages and benefits of the present invention.

SUMMARY

The present invention relates to a detergent granule with improved dissolution, containing, by weight of the granule, from about 10% to about 60% surfactant selected from the group consisting of nonionic surfactant, linear alkyl benzene sulfonate, and mixtures thereof. The detergent granule also contains from about 0.1% to about 10% water-insoluble disintegrant impregnated within the detergent granule, with the remainder being made up of optional other detersive ingredients.

This invention also relates to processes for impregnating the water-insoluble disintegrant within the detergent granule.

These and other features, aspects and advantages of the present invention will become evident to those skilled in the art from a reading of the present disclosure.

DETAILED DESCRIPTION

It has now been found that a detergent granule having nonionic and/or linear alkyl benzene sulfonate surfactants and a water-insoluble disintegrant impregnated within the detergent granule have surprisingly improved dissolution, especially in cold water. While the specification concludes with claims particularly pointing out and distinctly claiming the invention, it is believed that the present invention will be better understood from the following description.

All percentages are by weight of the detergent granule unless specifically stated otherwise.

All ratios are weight ratios unless specifically stated otherwise.

As used herein, "comprising" means that other steps and other ingredients which do not affect the end result can be added. This term encompasses the terms "consisting of" and "consisting essentially of".

As used herein, "cold water" means water which is at a temperature of below 30° C.

As used herein, "density" means bulk density unless specifically stated otherwise.

All cited references are incorporated herein by reference in their entireties. Citation of any reference is not an admission regarding any determination as to its availability as prior art to the claimed invention.

It has now been found that a detergent granule having, by weight of the granule, from about 10% to about 60% surfactant selected from the group consisting of nonionic surfactant, linear alkyl benzene sulfonate, and mixtures thereof, and from about 0.1% to about 10% water-insoluble disintegrant impregnated within the detergent granule can have surprisingly improved dissolution. The detergent granule has particularly improved dissolution in cold water.

As used herein, detergent granule is a granular particle containing at a minimum, a surfactant selected from the group consisting of nonionic surfactant, linear alkyl benzene sulfonate, and mixtures thereof, and a water-insoluble disintegrant impregranted with the detergent granule. The detergent granule can optionally comprise other detersive ingredients. Detergent compositions, such as laundry detergent compositions, may comprise such detergent granules, in addition to other optional detersive ingredients. The detergent granule preferably has a density from about 400 to about 1200 grams per liter, preferably from about 450 to about 950 grams per liter. The detergent granule preferably has a mean particle size of from about 200 microns to about 800 microns.

As used herein, impregnated within, means that the water-insoluble disintegrant is substantially ingrained into the interior and dispersed throughout the detergent granule.

As used herein, water-insoluble means substantially water-insoluble. Preferably, the solubility in water of the water-insoluble disintegrant is not more than about 25%, more preferably not more than about 10%.

It has been found that dissolution problems occur for detergent compositions having a high level of particular surfactants. Specifically, detergent granules having a high level of either a nonionic surfactant, linear alkyl benzene sulfonate surfactant, or a combination of both, have been found to possess dissolution problems, especially in cold water. Detergent granules having other surfactants, especially crystalline surfactants such as alkyl sulfates and alkyl alkoxy sulfates, also possess decreased dissolution when used in conjunction with nonionic and/or linear alkyl benzene sulfonate surfactants.

It has been found that the dissolution of detergent granules containing these surfactants can be improved by impregnating within the granule a water-insoluble disintegrant. Without intending to be limited by theory, it is believed that for detergent granules containing high levels of surfactant, hydration and dissolution occur on the surface of the detergent granule, wherein the detergent granule forms a hydrated paste, or gel-like mass. The formation of a gel-like mass, which have high levels of surfactant, occur upon contact with water, such as when the detergent granule comes into contact with a wash solution. The gel-like mass prevents a proportion of the detergent granule from being solubilized in the wash solution, which reduces the dissolution of the detergent granule.

For such detergent granules containing a high level of surfactant, it is believed that a disintegrant impregnated within the granule absorbs water through wicking action and expand once in contact with water. This expansion inside of the granule can then cause the granule to break into smaller pieces, increasing the surface area of the detergent granule. This increase in surface area exposes more of the detergent granule to the water in the wash solution, thereby improving the overall dissolution of the detergent granule, as well as the granular detergent composition as a whole.

The invention herein also includes a granular detergent composition containing the detergent granule described herein, as well as processes for making the detergent granule.

Surfactant

The detergent granule contains a surfactant selected from the group consisting of nonionic surfactant, linear alkyl benzene sulfonate, and mixtures thereof. The detergent granule can optionally contain other surfactants. Other surfactants, especially crystalline surfactants such as alkyl sulfates, alkyl alkoxy sulfates, and mixtures thereof, can also possess decreased dissolution when used in conjunction with nonionic and/or linear alkyl benzene sulfonate surfactants.

The detergent granule of the present invention contains, by weight of the granule, from about 10% to about 60% surfactant, preferably from about 15% to about 40% surfactant.

1. Nonionic surfactant

Polyethylene, polypropylene, and polybutylene oxide condensates of alkyl phenols are suitable for use as a nonionic surfactant in the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X- 102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are also suitable for use as a nonionic surfactant in the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, preferably from about 10 to about 18 carbon atoms, with from about 2 to about 10 moles of ethylene oxide per mole of alcohol. About 2 to about 9 moles, preferably from about 2 to about 5 moles of ethylene oxide per mole of alcohol are present in said condensation products. Examples of commercially available nonionic surfactants of this type include Tergitol™ 15-S-9 (the condensation product of $C_{11}$–$C_{15}$ linear alcohols with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohols with 9 moles of ethylene oxide), Neodo™ 23-3 (the condensation product of $C_{12}$–$C_{13}$ linear alcohols with 3.0 moles of ethylene oxide), Neodol™ 45-7 (the condensation product of $C_{14}$–$C_{15}$ linear alcohols with 7 moles of ethylene oxide), Neodol™ 45-5 (the condensation product of $C_{14}$–$C_{15}$ linear alcohols with 5 moles of ethylene oxide) marketed by Shell Chemical Company, Kyro™ EOB (the condensation product of $C_{13}$–$C_{15}$ alcohols with 9 moles ethylene oxide), marketed by The Procter & Gamble Company, and Genapol LA O3O or O5O (the condensation product of $C_{12}$–$C_{14}$ alcohols with 3 or 5 moles of ethylene oxide) marketed by Hoechst. Preferred range of HLB in these products is from 8–11 and most preferred from 8–10.

Also useful as a nonionic surfactant in the present invention are the alkylpolysaccharides disclosed in U.S. Pat. No. 4,565,647 to Llenado, issued Jan. 21, 1986, having a hydrophobic group containing from about 6 to about 30 carbon atoms, preferably from about 10 to about 16 carbon atoms and a polysaccharide, e.g. a polyglucoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units. Also useful herein are glucose-derived amides.

Preferred alkylpolyglycosides have the formula:

$$R^2O(C_nH_{2n}O)_t(\text{glcosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-, and/or 6-position, preferably predominately the 2-position.

The condensation products of ethylene oxide with a hydrophobic base formed by the condensation of propylene oxide with propylene glycol are also suitable for use as a nonionic surfactant in the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain commercially-available Pluronic™ surfactants, marketed by BASF.

Also suitable for use as a nonionic surfactant in the present invention are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain commercially available Tetronic™ compounds, marketed by BASF.

Especially preferred for use as the nonionic surfactant in the present invention are polyethylene oxide condensates of alkyl phenols, condensation products of primary and secondary aliphatic alcohols with from about 1 to about 25 moles of ethylene oxide, alkylpolysaccharides, and mixtures thereof. More preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Also preferred nonionic surfactants are polyhydroxy fatty acid amide surfactants of the formula:

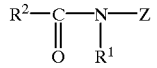

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16}$–$C_{18}$ alkyl or alkenyl chain such as coconut alkyl or mixtures thereof, and Z is derived from a reducing sugar such as glucose, fructose, maltose, lactose, in a reductive amination reaction.

When included herein, the amount of nonionic surfactant in the detergent granule comprises, by weight of the granule, from about 0% to about 60%, preferably from about 1% to about 20% nonionic surfactant.

2. Linear Alkyl Benzene Sulfonate

The linear alkyl benzene sulfonate (LAS) suitable for use herein includes the water-soluble salts, for example, the alkali metal, magnesium, ammonium and alkylolammonium salts of organic sulfuric reaction products having in their molecular structure an alkyl group containing from about 10 to about 20 carbon atoms and a sulfonic acid or sulfuric acid ester group. LAS and other carbon chain based compounds herein are abbreviated according to the average alkyl group length. For example, LAS with an average chain length of 12 carbon atoms is abbreviated as $C_{12}$ LAS, even though it contains a distribution of LAS molecules with alkyl groups of differing lengths. Preferred LAS useful herein are $C_{10-18}$ LASs. Especially valuable herein are linear straight chain alkyl benzene sulfonates in which the average number of carbon atoms in the alkyl group is from about 11 to 13, abbreviated as $C_{11-13}$ LAS. The alkali metal salts, particularly the sodium and potassium salts of these surfactants are preferred. Magnesium salt of LAS may also be useful in certain granule.

When included herein, the amount of LAS surfactant in the detergent granule comprises, by weight of the granule, from about 0% to about 60%, preferably from about 3% to about 30% LAS.

Water-insoluble Disintegrant

The detergent granule of the present invention contains from about 0.1% to about 10%, preferably from about 0.5% to about 7%, more preferably from about 1% to about 5%, by weight of the detergent granule, a water-insoluble disintegrant impregnated within the granule. The water-insoluble disintegrant useful herein is substantially water-insoluble, but can absorb water.

Accordingly, the water-insoluble disintegrant must be impregnated within the detergent granule, because a disintegrant limited to the outside of the detergent granule can fail to cause it to break up.

Preferred water-insoluble disintegrants are described in the Handbook of Pharmaceutical Excipients (1986). Examples of such suitable water-insoluble disintegrants include starch: natural, modified or pre-gelatinized starch (with less than 25% water soluble portion), Veegum (highly refined isomorphous silicate), crospovidone, cellulose, kaolin, crosslinked carboxy methyl cellulose (e.g., AcDiSol), microcrystalline cellulose (e.g., Avicel PH101 & PH102), crosslinked polyvinyl pyrrolidone (e.g., Kollidon CL), and mixtures thereof. More preferred disintegrants among these disintegrants include crosslinked carboxy methyl cellulose (e.g., AcDiSol), microcrystalline cellulose (e.g., Avicel PH101 & PH102), crosslinked polyvinyl pyrrolidone (e.g., Kollidon CL), and mixtures thereof.

This water-insoluble disintegrant must be impregnated into the granule in conditions where little, or preferably from about 1% to about 10% water, more preferably less than about 5% moisture or water is present at the time the disintegrant is impregnated.

Other Detersive Ingredients

In addition to the above, the detergent granule of the invention may optionally contain other detersive ingredients. The precise nature of these additional components, and levels of incorporation thereof will depend on the physical form of the composition, and the nature of the cleaning operation for which it is to be used.

The detergent granule of the invention may for example, be formulated as hand or machine laundry detergent compositions including laundry additive compositions and compositions suitable for use in the soaking and/or pretreatment of stained fabrics. Furthermore, the detergent granule of the invention can comprise other detersive ingredients.

Other Surfactant

In addition to nonionic surfactant and/or linear alkyl benzene sulfonate surfactant, other surfactants can optionally be included herein. It has been found that the dissolution of certain types of other surfactants, especially crystalline surfactants, such as for example, alkyl sulfates, can also benefit from the invention described herein. The preferred ratio of LAS and/or nonionic surfactant to a crystalline surfactant, is from about 10:1 to about 1:10. Without intending to be limited by theory, it is believed that the increased dissolution of the nonionic surfactant and/or the LAS surfactant produces a co-solubilization effect. As the dissolution of the nonionic surfactant and/or the LAS surfactant increases, this co-solubilization effect increases the dissolution of other surfactants. A preferred example of other surfactants include cationic surfactant, amphoteric surfactant, zwitterionic surfactant, and mixtures thereof. Other anionic surfactants besides LAS and crystalline surfactants are also preferred.

Nonlimiting examples of other surfactants useful in the detergent composition include, for example, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154 to Cook, et al., published Apr. 16, 1992. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Other conventional useful surfactants are listed in standard texts.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Potassium Ions

The detergent granule or a granular detergent composition containing the detergent granule may also contain from about 0.05% to about 50%, preferably from about 0.5% to about 30%, more preferably from about 1% to about 20%, by weight, of potassium ions.

The potassium ions useful herein can be provided from, for example, a potassium salt.

A preferred example of such a potassium salt can be selected from the group consisting of a potassium salt of alkali builders (e.g., potassium salts of carbonates, potassium salts of silicates), a potassium salt of mid-chain branched surfactants, and mixtures thereof.

Of the potassium salts, inorganic potassium salts are preferred, and are more preferably selected from the group consisting of potassium chloride (KCl), potassium carbonate ($K_2CO_3$), potassium sulfate ($K_2SO_4$), tetrapotassium pyrophosphate ($K_4P_2O_7$), tripotassium pyrophosphate ($HK_3P_2O_7$), dipotassium pyrophosphate ($H_2K_2P_2O_7$), and monopotassium pyrophosphate ($H_3KP_2O_7$), pentapotassium tripolyphosphate ($K_5P_3O_{10}$), tetrapotassium tripolyphosphate ($HK_4P_3O_{10}$), tripotassium tripolyphosphate ($H_2K_3P_3O_{10}$), dipotassium tripolyphosphate ($H_3K_2P_3O_{10}$), and monopotassium tripolyphosphate ($H_4KP_3O_{10}$); potassium hydroxide (KOH); potassium silicate; potassium citrate, potassium longer alkyl chain, mid-chain branched surfactant compounds, linear potassium alkylbenzene sulfonate, potassium alkyl sulfate, potassium alkylpolyethoxylate, and mixtures thereof. These are commercially available. Inorganic potassium salts may be dehydrated (preferably) or hydrated. Of the hydrates, those which are stable up to about 120° F. (48.9° C.) are preferred. Potassium carbonate is most preferred.

Also suitable for use herein are salts of film forming polymers as described in U.S. Pat. No. 4,379,080 to Murphy, issued Apr. 5, 1983, column 8, line 44 to column 10, line 37, incorporated herein, which are either partially or wholly neutralized with potassium. Particularly preferred are the potassium salts of copolymers of acrylamide and acrylate having a molecular weight between about 4,000 and 20,000.

Filler Salts

In conventional detergent compositions, the filler salts are preferably present in substantial amounts, typically 17–35% by weight of the total composition. As one embodiment, the "compact" form of the composition herein is best reflected by high density (e.g. 500 g/liter to 950 g/liter) and, in terms of granule, by a reduced amount of inorganic filler salt. Inorganic filler salts are conventional optional ingredients of detergent granules in powder form. In the composition, the filler salt is preferably present in amounts not exceeding 25% of the total composition, preferably not exceeding 15%, most preferably not exceeding 5% by weight of the composition.

The inorganic filler salts, such as meant in the present compositions are selected from the alkali and alkaline-earth-metal salts of sulfates and chlorides. A preferred filler salt is sodium sulfate.

Enzymes

The present invention can comprise one or more enzymes which provide cleaning performance and/or fabric care benefits.

Said enzymes include enzymes selected from, hemicellulases, peroxidases, proteases, gluco-amylases, cellulases, amylases, xylanases, lipases, esterases, cutinases, pectinases, reductases, oxidases, phenoloxidases, lipoxygenases, ligninases, pullulanases, tannases, pentosanases, malanases, β-glucanases, arabinosidases chondroitinase, laccase or mixtures thereof.

Bleaching Agent

Bleach systems that can be included in the present invention include bleaching agents such as anhydrous sodium perborate monohydrate, anhydrous sodium perborate tetrahydrate and percarbonate with a particle size of from about 400 to about 800 microns in diameter. These bleaching agent components can include one or more oxygen bleaching agents and, depending upon the bleaching agent chosen, one or more bleach activators. When present oxygen bleaching compounds will typically be present at levels of from about 1% to about 25%.

The bleaching agent component for use herein can be any of the bleaching agents useful for detergent compositions including oxygen bleaches as well as others known in the art. The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybytyric acid and diperoxydodecanedioic acid. Such bleaching agents are disclosed in U.S. Pat. No. 4,483,781 to Hartman, issued Nov. 20, 1984, U.S. patent application Ser. No. 740,446 to Burns et al., filed Jun. 3, 1985, European Patent Application 0,133,354 to Banks et al., published Feb. 20, 1985, and U.S. Pat. No. 4,412,934 to Chung and Spadini, issued Nov. 1, 1983. Highly preferred oxygen bleaches also include 6-nonylamino-6-oxoperoxycaproic acid (NAPAA) as described in U.S. Pat. No. 4,634,551 to Hardy and Ingram, issued Jan. 6, 1987.

The hydrogen peroxide releasing agents can be used in combination with bleach activators such as tetraacetylethylenediamine (TAED), nonanoyloxybenzene-sulfonate (NOBS, described in U.S. Pat. No. 4,412,934 to Chung and Spadini, issued Nov. 1, 1983), 3,5,-trimethylhexanoloxybenzenesulfonate (ISONOBS, described in EP 120,591) or pentaacetylglucose (PAG), which are perhydrolyzed to form a peracid as the active bleaching species, leading to improved bleaching effect. Also suitable activators are acylated citrate esters.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718, issued Jul. 5, 1977 to Holcombe, et al. Typically, detergent compositions will contain about 0.025% to about 1.25%, by weight, of sulfonated zinc phthalocyanine.

Builder System

The present invention may further comprise a builder system.

Any conventional builder system is suitable for use herein including aluminosilicate materials, silicates, polycarboxylates and fatty acids, materials such as ethylenediamine tetraacetate, diethylene triamine pentamethyleneacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein where permitted.

Suitable builders can be an inorganic ion exchange material, commonly an inorganic hydrated aluminosilicate material, more particularly a hydrated synthetic zeolite such as hydrated zeolite A, X, B, HS or MAP. Another suitable inorganic builder material is layered silicate, e.g. SKS-6 (Hoechst). SKS-6 is a crystalline layered silicate consisting of sodium silicate ($Na_2Si_2O_5$). Polycarboxylates builder systems can also be useful herein, such as, for example those disclosed in Belgian Patent Nos. 831,368, 821,369 and 821,370.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in GB Patent Nos. 1,398,421 and 1,398,422 and in U.S. Pat. No. 3,936,448, and the sulfonated pyrolysed citrates described in GB Patent No. 1,082,179, while polycarboxylates containing phosphone substituents are disclosed in GB Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydro-furan-cis, cis, cis-tetracarboxylates, 2,5-tetrahydro-furan -cis-dicarboxylates, 2,2,5,5-tetrahydrofuran-tetracarboxylates, 1,2,3,4,5,6-hexane-hexacar-boxylates and carboxymethyl derivatives of polyhydric alcohols such as sorbitol, mannitol and xylitol. Aromatic poly-carboxylates include mellitic acid, pyromellitic acid and the phthalic acid derivatives disclosed in GB Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (SKS-6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Preferred builder systems include a mixture of a water-insoluble aluminosilicate builder such as zeolite A, and a water-soluble carboxylate chelating agent such as citric acid.

Other builder materials that can form part of the builder system for use in non-liquid compositions include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2,000–10,000 and their copolymers with maleic anhydride, such copolymers having a molecular weight of from about 4,000 to about 80,000, especially from about 5,000 to about 20,000.

Detergency builder systems are normally included in amounts of from 5% to 60% by weight of the composition preferably from 10% to 50% and most usually from 20% to 40% by weight.

Softening Agents

Fabric softening agents can also be incorporated into laundry detergent compositions in accordance with the present invention. These agents may be inorganic or organic in type. Inorganic softening agents are exemplified by the smectite clays disclosed in GB-A-1 400 898 and in U.S. Pat. No. 5,019,292. Organic fabric softening agents include the water insoluble tertiary amines as disclosed in GB-A1 514 276 and EP-B0 011 340 and their combination with mono $C_{12}$–$C_{14}$ quaternary ammonium salts are disclosed in EP-B-0 026 527 and EP-B-0 026 528 and di-long-chain amides as disclosed in EP-B-0 242 919. Other useful organic ingredients of fabric softening systems include high molecular weight polyethylene oxide materials as disclosed in EP-A-0 299 575 and 0 313 146.

Levels of smectite clay are normally in the range from 2% to 20%, more preferably from 5% to 15% by weight, with the material being added as a dry mixed component to the remainder of the formulation.

Dye Transfer Inhibitors

The detergent composition of the present invention can also include compounds, such as polymers, for inhibiting dye transfer from one fabric to another of solubilized and suspended dyes encountered during fabric laundering operations involving colored fabrics.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof.

Other components used in detergent compositions may be employed, such as soil-suspending agents, soil-release agents, optical brighteners, abrasives, bactericides, tarnish inhibitors, coloring agents, suds suppressers, enzyme stabilizers, and/or encapsulated or non-encapsulated perfumes.

Process

The following describes four preferred types of processes. The following examples further describe and demonstrate the preferred embodiments within the scope of the present invention. The examples are given solely for the purpose of illustration, and are not to be construed as limitations of the present invention since many variations thereof are possible without departing from its spirit and scope.

EXAMPLE 1

The example 1 process is characterized by the following steps:

A. forming a detergent particle by spray-drying an aqueous detergent slurry comprising a surfactant selected from the group consisting of nonionic surfactant, linear alkyl benzene sulfonate, and mixtures thereof; and B. impregnating a water-insoluble disintegrant within the detergent particle by compacting the aqueous detergent slurry and the water-insoluble disintegrant.

In the above step A, the aqueous detergent slurry may further include carbonate, builder such as zeolite A, polymers, cationic surfactant, sodium silicate and/or water. In the above step A, a spray drying tower is preferably used for spray drying. In the above step B, the compacting is conducted by using a mixer (e.g. using KM mixer of Littleford Inc.). In the above step B, the compacting impregnates the water-insoluble disintegrant within the detergent granule, and includes (1) granulation and densification process in a medium/high shear batch mixer/granulator, or (2) continuous granulation and densification process (e.g. using Lodige® CB mixer and/or Lodige® KM mixer), (3) use of a fluid bed process, (4) use of a compaction process (e.g., roll compaction) and/or (5) use of an extrusion process. Once formed, the medium to high density detergent granules thus obtained can be coated by nonionic surfactant and/or builder or a flow aid such as zeolite A, and/or can be subsequently mixed with additives such as enzymes, bleach, perfume and crystalline layered silicate, etc.

EXAMPLE 2

The example 2 process is characterized by the step of impregnating a water-insoluble disintegrant within a detergent agglomerate simultaneously during a dry-neutralization process, wherein a linear alkyl benzene sulfonic acid is neutralized in the presence of an alkaline material. Preferably, the detergent granule is prepared by cooling the detergent agglomerate in the cooler.

In the example 2 process, it is the use of a mixer under a dry-neutralization condition which impregnates the water-insoluble disintegrant within the detergent granule. The mixer useful herein can be, for example, a high speed mixer/densifier, or a variable-speed speed mixer/densifier. Alternatively, two or more mixers/densifiers can be used, for example, where a high speed mixer (e.g., a Lodige® CB mixer) is first used, and then a moderate speed mixer (e.g., Lodige® KM mixer) is used. The cooler useful herein can be, for example, a fluid bed cooler in which the detergent agglomerates are cooled and fines are removed. It is preferred that the detergent agglomerate has a density of from about 600 to about 950 grams per liter and a mean particle size of from about 250 microns to about 400 microns in diameter. It is preferred that the detergent granule have a density of from about 550 to about 850 grams per liter and a mean particle size of from about 400 microns to about 500 microns in diameter.

In the example 2 process, a non-liquid other surfactant can be further included with the builder and the water-insoluble disintegrant. Preferred optional detersive ingredients include enzymes, brighteners, NOBS, perborate, CMC, DTPA, perfume and soil-release agents, and can be dry blended with the cooled detergent agglomerates.

EXAMPLE 3

The example 3 process is characterized by the following steps:

A. providing a nonionic surfactant, an alkaline material, a builder, and a water-insoluble disintegrant;

B. providing a mixer and a cooler;

C. obtaining a detergent agglomerate by agglomerating the nonionic surfactants, alkaline material, builder, and water-insoluble disintegrant within the mixer; and D. preparing a detergent granule by cooling the detergent agglomerate in the cooler.

In the example 3 process, it is the use of a mixer under agglomeration conditions which impregnates the water-insoluble disintegrant within the detergent granule. This nonionic agglomerate can either be used as an intermediate in a granular composition, or mixed with other detersive ingredients. All other characteristics and equipment of the example 3 process are the same as in the example 2 process detailed above.

The disintegrant may also be added in the medium shear mixer (e.g. Loedige® KM mixer) and a non-aqueous binder like polyvinyl alcohol (PVA) or polyethylene glycol (PEG) may be used to reagglomerate the disintegrant with the mix coming out of the high shear mixer (e.g. Loedige® CB mixer).

EXAMPLE 4

The example 4 process is characterized by the following steps:

A. forming a wet detergent agglomerate by agglomerating a high active paste form of a surfactant, an alkaline material, a builder, and other optional detersive ingredients in a high shear mixer followed by a medium shear mixer;

B. drying the wet detergent agglomerate to obtain a dried detergent agglomerate, wherein the dried detergent agglomerate has a moisture content from about 1% to about 10%, preferably less than about 5%; and C. impregnating a water-insoluble disintegrant within the dried detergent agglomerate by further agglomerating the water-insoluble disintegrant, the dried detergent agglomerate and a non-aqueous binder in a medium shear mixer.

Specifically, a high active paste form of surfactant (70–80% active AS, AES,LAS paste) is agglomerated with sodium carbonate, builders (Zeolite A/STPP) and other inorganic and organic solids present in the formulation in a continuous high shear mixer (e.g. Lodige® CB mixer) followed by further agglomeration in a medium shear mixer (e.g. Lodige® KM mixer). The wet agglomerate is then preferably dried in a fluid bed drier to reduce the moisture content, preferably from about 1% to about 10% and more preferably less than about 5%. The dried agglomerate is then mixed with the disintegrant in a medium shear mixer (e.g. Lodige® KM mixer) and reagglomerated using a non-aqueous binder (e.g. PVA/PEG). Other detergent additives are then mixed with the final agglomerate containing the disintegrant to make the finished product.

In the following examples, the abbreviated component identifications have the following meanings:

| | |
|---|---|
| NaLAS | Sodium linear $C_{12}$ alkyl benzene sulfonate |
| KLAS | Potassium linear $C_{12}$ alkyl benzene sulfonate |
| AS | Alkyl Sulfate |
| AEXS | Alkyl Ethoxy Sulfate (X represents ethoxy number) |
| $NaC_{X-Y}AS$ | Sodium $C_X$–$C_Y$ alkyl sulfate |
| $KC_{X-Y}AS$ | Potassium $C_X$–$C_Y$ alkyl sulfate |
| 25EY | A $C_{12}$–$C_{15}$ predominantly linear primary alcohol condensed with an average of Y moles of ethylene oxide |

-continued

| | |
|---|---|
| NaSKS-6 | Crystalline layered silicate of formula δ-$Na_2Si_2O_5$ |
| Phosphate or STPP | Sodium tripolyphosphate |
| MA/AA | Copolymer of 4:1–1:4 maleic/acrylic acid, average molecular weight about 4,000–80,000 |
| NOBS | Nonanoyloxy benzene sulfonate in the form of the sodium salt |
| PB4 | Anhydrous sodium perborate tetrahydrate. |
| TAED | Tetraacetyl ethylene diamine |
| CMC | Sodium carboxymethyl cellulose |
| SRA | Soil Release Agents |
| DTPA | Diethylene triamine penta acetate |

EXAMPLE 5

An aqueous slurry comprising anionic surfactants such as NaLAS and Na $C_{14-15}AS$; cationic surfactants such as coco-alkyl methyl bis (hydroxyethyl) ammonium chloride; polymer builder such as MA/AA; Zeolite A as builder; carbonate; silicate and/or sulfate is prepared and spray-dried in a spray-drier to obtain a low density detergent granule. The low density tower detergent granule is then mixed with a water-insoluble disintegrant such as microcrystalline cellulose, crosslinked carboxymethyl cellulose or crosslinked polyvinyl pyrrolidone in a mixer (e.g. KM mixer by Littleford, Inc.). The mixture is then compacted in a roll compactor to impregnate the water-insoluble disintegrant within the mixture. The roll compactor also increases the density of the mixture to form high density "chips." The high density (about 1200–1300 g/l) chips from the compactor are then ground to the desired particle size distribution in a cage mill or a hammer mill to obtain a high density detergent granule (about 700–750 g/l). The high density detergent granule is then coated with nonionic surfactants (e.g., 25E9 and Zeolite A) and precipitated silica as flow aids. Other additives such as NaSKS-6, enzymes, brighteners, NOBS, perborate, percarbonate, perfume and SRP are dry-added to these high density granules and mixed to make the finished detergent granule. Compositions A through D are shown below and are made according to Example 5.

| Composition | A | B | C | D |
|---|---|---|---|---|
| NaLAS | 24.00 | 22.00 | 22.00 | 22.00 |
| $NaC_{14-15}AS$ | 4.00 | 4.00 | 4.00 | 4.00 |
| 25E9 | 3.50 | 3.50 | 3.50 | 3.50 |
| Cationics | 0.50 | 1.20 | 1.20 | 1.20 |
| NaSKS-6 | 7.50 | 6.00 | 6.00 | 6.00 |
| Zeolite A | 12.00 | 11.00 | 11.00 | 11.00 |
| Silicate | 12.00 | 12.50 | 12.50 | 12.50 |
| MA/AA | 7.00 | 14.00 | 14.00 | 14.00 |
| Carbonate | 15.00 | 11.00 | 11.00 | 11.00 |
| Sulfate | 3.00 | 0.00 | 0.00 | 0.00 |
| microcrystalline cellulose (Avicel) | 0.00 | 0.00 | 4.00 | 0 |
| crosslinked carboxymethyl cellulose (AcDiSol) | 2.00 | 4.00 | 0.00 | 0 |
| crosslinked polyvinyl pyrrolidone (Kollidon CL) | 0.00 | 0.00 | 0.00 | 4 |
| Enzymes | 0.20 | 1.95 | 1.95 | 1.95 |
| Brighteners | 0.30 | 0.30 | 0.30 | 0.30 |
| NOBS | 3.75 | 3.00 | 3.00 | 3.00 |
| Perborate | 3.50 | 0.00 | 0.00 | 0.00 |
| Percarbonate | 0.00 | 3.00 | 3.00 | 3.00 |
| Perfume | 0.06 | 0.08 | 0.08 | 0.08 |
| SRA | 0.7 | 0.7 | 0.7 | 0.7 |

EXAMPLE 6

In this process example the surfactant system is changed to either a mixture of Na and K surfactants or only K surfactants. All other steps are same as Example 5.

Compositions E though H shown below are made according to Example 6. In addition, citric acid monohydrate is added in compositions G and H.

| Composition | E | F | G | H |
|---|---|---|---|---|
| NaLAS | 11.00 | 0.00 | 22.00 | 0.00 |
| KLAS | 11.00 | 22.00 | 0.00 | 22.00 |
| $NaC_{14-15}AS$ | 4.00 | 0.00 | 4.00 | 4.00 |
| $KC_{14-15}AS$ | 0.00 | 4.00 | 0.00 | 0.00 |
| 25E9 | 3.50 | 3.50 | 3.00 | 3.00 |
| Cationics | 1.20 | 1.20 | 1.20 | 1.20 |
| NaSKS-6 | 6.00 | 6.00 | 5.00 | 5.00 |
| Zeolite A | 11.00 | 11.00 | 10.00 | 10.00 |
| Silicate | 12.50 | 12.50 | 10.00 | 10.00 |
| MA/AA | 14.00 | 14.00 | 14.00 | 14.00 |
| Carbonate | 11.00 | 11.00 | 13.00 | 13.00 |
| crosslinked carboxymethyl cellulose (AcDiSol) | 3.00 | 3.00 | 3.00 | 3.00 |
| citric acid monohydrate | 0.00 | 0.00 | 3.00 | 3.00 |
| Enzymes | 2.00 | 2.00 | 2.00 | 2.00 |
| Brighteners | 0.30 | 0.30 | 0.30 | 0.30 |
| NOBS | 3.00 | 3.00 | 3.00 | 3.00 |
| Perborate | 3.00 | 0.00 | 0.00 | 0.00 |
| Percarbonate | 0.00 | 3.00 | 3.00 | 3.00 |
| SRA | 0.70 | 0.70 | 0.70 | 0.70 |
| Perfume | 0.08 | 0.08 | 0.08 | 0.08 |

EXAMPLE 7

200 kg/hr of linear alkyl benzene sulfonic acid (96% active) is dispersed by the tools of a CB 30 mixer (Lodige® CB mixer) along with 360 kg/hr of STPP, 200 kg/hr of ground sodium carbonate or light soda ash, and 10–100 kg/hr of a water-insoluble disintegrant such as microcrystalline cellulose, crosslinked carboxymethyl cellulose or crosslinked polyvinyl pyrrolidone. This action impregnates the water-insoluble disintegrant within the mixture. 10–20 kg/hr of cationic solution (40% active) is also dispersed thereto. In compositions 10 & 11, dried flakes of Na $C_{12}$–$C_{18}$AS and/or AE3S is added along with the builders and carbonate. The sulfonic acid is neutralized in this step with the carbonate. The partially agglomerated mixture from the CB 30 mixer is fed into a KM 600 mixer (Lodige® KM mixer) for further agglomeration. In this step 40–100 kg/hr of Zeolite A is added as a flow aid. Mean residence time in this mixer is 3–6 minutes and the mixer speed is 100–150 rpm. The agglomerate mixture is then cooled in a fluid bed cooler and fines are stripped off in this step and recycled to the CB 30 mixer. Other performance ingredients such as enzymes, brighteners, NOBS, perborate, CMC, DTPA, perfume and soil release agents are dry blended with the agglomerate.

Compositions I through K shown below are made according to Example 7.

| Composition | I | J | K |
|---|---|---|---|
| NaLAS | 20.00 | 20.00 | 3.50 |
| AE3S | 0.00 | 1.00 | 1.00 |
| $NaC_{12}$–$C_{18}$AS | 0.00 | 0.00 | 20.00 |
| 25E9 | 1.20 | 1.20 | 0.00 |
| Cationics | 0.30 | 0.60 | 0.60 |
| STPP | 30.00 | 36.00 | 25.00 |
| Zeolite A | 0.00 | 6.00 | 5.00 |
| Silicate | 5.00 | 4.00 | 6.00 |

-continued

| Composition | I | J | K |
|---|---|---|---|
| acrylic acid polymer | 1.00 | 0.00 | 0.00 |
| MA/AA | 0.00 | 0.90 | 1.00 |
| polyethylene amine | 0.30 | 0.00 | 0.00 |
| Carbonate | 10.00 | 16.00 | 25.00 |
| Sulfate | 25.00 | 0.00 | 0.00 |
| microcrystalline cellulose(Avicel) | 0.00 | 3.00 | 0.00 |
| crosslinked carboxymethyl cellulose (AcDiSol) | 3.00 | 0.00 | 0.00 |
| crosslinked polyvinyl pyrrolidone (Kollidon CL) | 0.00 | 0.00 | 2.00 |
| Enzymes | 1.05 | 1.00 | 0.30 |
| Brighteners | 0.40 | 0.40 | 0.20 |
| NOBS | 0.00 | 2.00 | 2.00 |
| Perborate | 0.00 | 2.50 | 2.50 |
| CMC | 0.40 | 0.40 | 0.40 |
| DTPA | 0.00 | 0.90 | 0.90 |
| Perfume | 0.25 | 0.25 | 0.50 |
| SRA | 0.00 | 0.20 | 0.20 |

EXAMPLE 8

Nonionic surfactant such as $C_{25}$AE5 (180 kg/hr) and glucose amide paste (85 kg/hr) are dispersed by the tools of a CB 30 mixer (Lodige® CB mixer) along with 400 kg/hr of Zeolite A, 80 kg/hr of ground sodium carbonate or light soda ash, and 100 kg/hr of a water-insoluble disintegrant (such as microcrystalline cellulose, crosslinked carboxymethyl cellulose or crosslinked polyvinyl pyrrolidone). The partially agglomerated mixture from the CB 30 mixer is fed into a KM 600 mixer (Lodige® KM mixer) for further agglomeration. In this step 100 kg/hr of Zeolite A is added as flow aid. The agglomerate mixture is then cooled in a fluid bed cooler where fines are stripped off in this step to be recycled into the CB 30 mixer. This nonionic agglomerate can be used as an intermediate product to be dry added to other agglomerates or granules containing other surfactants, builders etc. Composition L is an example of this approach. Alternatively, this agglomerate can be mixed with other performance ingredients like enzymes, brighteners, NOBS, perborate, CMC, DTPA, perfume and soil release agents to make the finished product. Composition M is an example of this.

Compositions L and M are shown below are made according to Example 8, described above. The nonionic agglomerate of Compositions L and M contain the following, by weight of the nonionic agglomerate:

| | |
|---|---|
| $C_{25}$AE5 | 18.00 |
| Glucose Amide | 6.00 |
| Zeolite A | 50.00 |
| Carbonate | 8.00 |
| AcDiSol (water-insoluble disintegrant) | 10.00 |
| Moisture | 4.00 |
| Miscellaneous | 4.00 |

| Composition | L | M |
|---|---|---|
| NaLAS | 1.00 | 0.00 |
| NaAE3S | 2.00 | 0.00 |
| NaAS | 7.00 | 0.00 |
| Nonionic agglomerate | 20.00 | 80.00 |
| Sulfate | 6.00 | 0.00 |
| NaSKS-6 | 11.00 | 0.00 |
| Zeolite A | 11.00 | 0.00 |
| Carbonate | 7.00 | 10.00 |
| Citric acid monohydrate | 3.00 | 0.00 |

-continued

| | | |
|---|---|---|
| Polycarboxylate | 3.00 | 0.00 |
| Percarbonate | 18.00 | 3.00 |
| TAED | 5.00 | 0.00 |
| NOBS | 0.00 | 3.00 |
| Enzymes | 1.00 | 1.00 |
| Brighteners | 0.25 | 0.30 |
| SRA | 0.20 | 0.30 |
| CMC | 0.35 | 0.00 |
| Suds Suppresser | 0.35 | 0.00 |
| Perfume | 0.45 | 0.10 |
| Moisture | 3.40 | 2.00 |

What is claimed is:

1. A process for preparing a detergent granule comprising (a) from about 10% to about 60% by weight of a surfactant selected from the group consisting of nonionic surfactant, linear alkyl benzene sulfonate, and mixtures thereof; (b) from 5% to 60% by weight of a builder; (c) from about 0.1% to about 10% by weight of water-insoluble disintegrant impregnated within the detergent granule; and (d) optionally, other detersive ingredients, said process comprising the steps of:

A. forming a wet detergent agglomerate by agglomerating a high active paste form of said surfactant, said builder, and said other optional detersive ingredients in a high shear mixer followed by a medium shear mixer;

B. drying the wet detergent agglomerate to obtain a dried detergent agglomerate, wherein the dried detergent agglomerate has a moisture content from about 1% to about 10%; and C. impregnating said water-insoluble disintegrant within the dried detergent agglomerate by further agglomerating the water-insoluble disintegrant, the dried detergent agglomerate and a non-agueous binder in a medium shear mixer.

* * * * *